US010889473B2

(12) United States Patent
Ceresoli et al.

(10) Patent No.: US 10,889,473 B2
(45) Date of Patent: Jan. 12, 2021

(54) LOAD CRANE MAIN BOOM

(71) Applicant: Fassi Gru S.P.A, Albino (IT)

(72) Inventors: Rossano Ceresoli, Ranica (IT); Giovanni Fassi, Bergamo (IT)

(73) Assignee: Fassi Gru S.P.A., Albino (IT)

( * ) Notice: Subject to any disclaimer, the term of this patent is extended or adjusted under 35 U.S.C. 154(b) by 134 days.

(21) Appl. No.: 16/343,952

(22) PCT Filed: Dec. 9, 2016

(86) PCT No.: PCT/EP2016/080413
§ 371 (c)(1),
(2) Date: Apr. 22, 2019

(87) PCT Pub. No.: WO2018/103859
PCT Pub. Date: Jun. 14, 2018

(65) Prior Publication Data

US 2019/0248630 A1 Aug. 15, 2019

(51) Int. Cl.
*B66C 23/70* (2006.01)
*B66F 11/04* (2006.01)

(52) U.S. Cl.
CPC ..... *B66C 23/705* (2013.01); *B66C 23/701* (2013.01); *B66F 11/046* (2013.01)

(58) Field of Classification Search
CPC ..... B66C 23/00; B66C 23/04; B66C 23/701; B66C 23/702; B66C 23/703; B66C 23/705; B66C 23/706; B66C 23/707; B66C 23/708; B66F 11/046
See application file for complete search history.

(56) References Cited

U.S. PATENT DOCUMENTS 3,419,157 A * 12/1968 Brady ..... B66C 23/705 212/349
3,658,189 A 4/1972 Brown et al.
3,721,054 A * 3/1973 Hornagold ..... B66C 23/701 52/115
3,736,710 A * 6/1973 Sterner ..... B66C 23/705 52/115
3,777,629 A * 12/1973 Johnston ..... F15B 21/08 91/524

(Continued)

FOREIGN PATENT DOCUMENTS

EP 0217294 A2 4/1987
NL 7312849 A 3/1974
WO 2013005978 A2 1/2013

*Primary Examiner* — Michael R Mansen
*Assistant Examiner* — Juan J Campos, Jr.
(74) *Attorney, Agent, or Firm* — Mark Malek; Widerman Malek, PL

(57) ABSTRACT

A load crane main boom of the telescopic type having cylinder-piston groups located inside the main boom tubular sections with reduced dimensions. The load crane main boom minimizes the main boom section thanks to a particular arrangement of the cylinder-piston groups. Each cylinder of each piston-cylinder group is connected to a respective boom section through at least one reinforcing rod extending perpendicular to the main boom axial direction and connected to respective section walls of the main boom. At least first and the second cylinder-piston group rods are further supported by a respective reinforcing plate, which is in turn connected to the respective boom section.

12 Claims, 6 Drawing Sheets

(56) References Cited

U.S. PATENT DOCUMENTS

| | | | | | |
|---|---|---|---|---|---|
| 3,804,262 | A | * | 4/1974 | Wiencek | B66C 23/705 212/349 |
| 3,807,108 | A | * | 4/1974 | Johnston | B66C 23/701 52/115 |
| 3,809,249 | A | * | 5/1974 | Grove | B66C 23/701 212/349 |
| 3,841,494 | A | | 10/1974 | Chalupsky et al. | |
| 4,133,411 | A | * | 1/1979 | Curb | B66F 11/046 182/2.11 |

* cited by examiner

LOAD CRANE MAIN BOOM

BACKGROUND

Technical Field

The present invention relates to a load crane, in particular to a load crane main boom of the telescopic type having actuating cylinder-piston groups located inside the telescopic sections of the main boom.

Description of the Related Art

Load cranes comprise at least one boom comprising a plurality of tubular sections movable telescopically one relative to each other. Said telescopic boom can in turn be connected to a secondary telescopic boom or, alternatively, at the end of the main boom a movable load support can be provided.

With reference to the telescopic main boom, each section is connected to a respective cylinder-piston group which moves the subsequent sections. For example, in a boom having a fixed first section and movable four (second, third, fourth and fifth) sections:

a first cylinder-piston group is connected to the fixed first section and moves the second section, movable relative to the first section. The third, fourth and fifth sections move integrally with the second section when moved by the first cylinder-piston group;

a second cylinder-piston group is connected to the movable second section and moves the third section, movable relative the second section. The fourth and fifth sections move integrally with the third section when moved by the second cylinder-piston group;

a third cylinder-piston group is connected to the movable third section and moves the fourth section, movable relative to the third section. The fifth section moves integrally with the fourth section when moved by the third cylinder-piston group;

a fourth cylinder-piston group is connected to the movable fourth section and moves the fifth section, movable relative to the fourth section.

According to a very appreciated type of load crane main booms, the first, second, third and fourth cylinder-piston groups are located inside the boom tubular sections in order to reduce the overall dimensions of the main boom. Furthermore, this solution reduces the risk of damages of the crane hydraulic system, which is protected since the cylinder-piston groups are not externally arranged.

In order to achieve this arrangement, each cylinder of the piston-cylinder group is connected to the respective boom section through at least one reinforcing rod extending perpendicular to the main boom axial direction and connected to the respective section walls. Due to the high load they must be able to support, at least the first and the second cylinder-piston group rods are further supported by a respective reinforcing plate, which is in turn connected to the respective boom section. The cylinder-piston groups are hydraulically connected, so the hydraulic connections between the cylinder-piston groups must be arranged inside the tubular sections, too. The hydraulic connections, typically hydraulic tubes, extend inside the boom and form several bends. As a consequence, the main boom dimensions are influenced by the presence of said hydraulic tubes.

When designing a load crane main boom the following constraints must be considered.

The main boom must have a predefined maximum length (i.e. the boom length when all the sections are in the extended position) and must be able to support a maximum load. This influences the cylinder-piston groups dimensions because the piston force depends from the piston area and from the oil pressure. Moreover, the piston area cannot be too reduced because the cylinder-piston group must be able to support peak loads when the main boom is oriented in specific positions, for example vertically oriented. Furthermore, the main boom sections must be able to move at a predefined speed, so a minimum predefined oil flow rate must be provided. As a consequence, the hydraulic tubes must have a minimum diameter and a minimum bending radius.

Moreover, the crane is usually supported by a truck having specific dimensions. It is therefore necessary that the boom, when the sections are in the retracted positions, has a limited length. In order to achieve this result, it is necessary to provide the boom with a high number, typically four, of movable sections and of corresponding cylinder-piston groups. For the same reasons, the crane weight should be as reduced as possible.

Further constraints imposed by the arrangement of the boom on a truck are the necessity of a sufficient space under the boom when the boom is horizontally oriented on the truck such that a high volume of goods can be positioned on the truck in the space under the boom. Furthermore, given that the column supporting the crane must be higher than the truck cabin, the crane height when the boom is horizontally oriented must be limited. These constraints impose a limited maximum section of the boom which, on the other hand, must be sufficient to ensure the boom to have an adequate bend strength.

BRIEF SUMMARY OF THE INVENTION

The object of the present invention is therefore to provide a load crane main boom of the telescopic type having cylinder-piston groups located inside the main boom tubular sections with reduced dimensions.

This and other objects are achieved by a load crane main boom in accordance with claim 1, which minimizes the main boom section thank to a particular arrangement of the cylinder-piston groups, given the boom working constraints discussed above.

Dependent claims define possible advantageous embodiments of the invention.

BRIEF DESCRIPTION OF THE DRAWINGS

Further characteristics and advantages of the load crane main boom according to the invention will be more apparent from the following description of a preferred embodiment and of its alternatives given as a way of an example with reference to the enclosed drawings in which.

DETAILED DESCRIPTION

In the following detailed description identical components have the same reference numbers, regardless of whether they are shown in different embodiments of the present invention. Furthermore, in order to clearly and concisely disclose the present invention, the drawings may not necessarily be to scale and certain features of the invention may be shown in somewhat schematic form.

Figure 1:
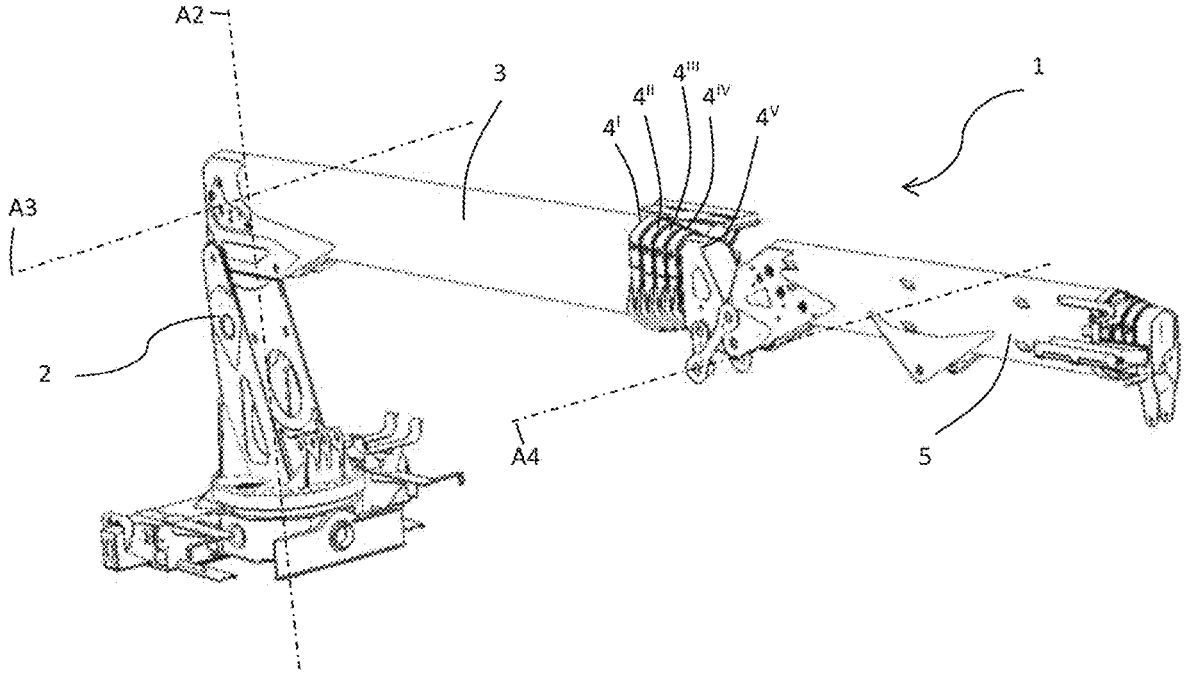
FIG. 1 is a perspective view of a load crane comprising a main boom according to a possible embodiment of the invention.

With reference to the annexed FIG. 1, a crane, in particular a load crane, is indicated with reference number 1. The crane 1 comprises a column 2 rotatable around a vertical axis A2. The crane 1 further comprises a main boom 3 connected to the column 2 in a rotatable manner around an axis A3 transversal to the axis A2. The main boom 3 comprises a plurality of boom sections $\mathbf{4}^{I} \ldots \mathbf{4}^{V}$ telescopically arranged one relative each other such that each section can slide relative to the previous section between a retracted position and an extended position. To the main boom 3 a secondary boom 5 can be connected, rotatable relative to the main boom 3 around an axis A4 which is preferably parallel to the axis A3. The secondary boom 5 can in turn comprise a plurality of sections telescopically arranged one relative each other. At the end of the secondary boom 5 a movable load support (not shown in the figures) can be provided. Alternatively, the secondary boom 5 can be missing and the load support can be provided at the end of the main boom 3.

Figure 2:
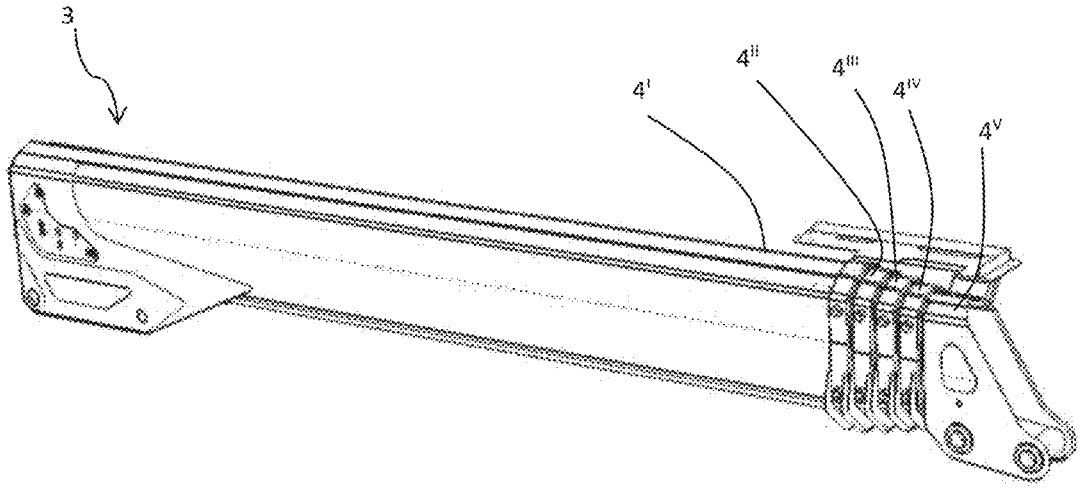
FIG. 2 is a perspective view of a load crane main boom according to a possible embodiment of the invention.
Figure 3:
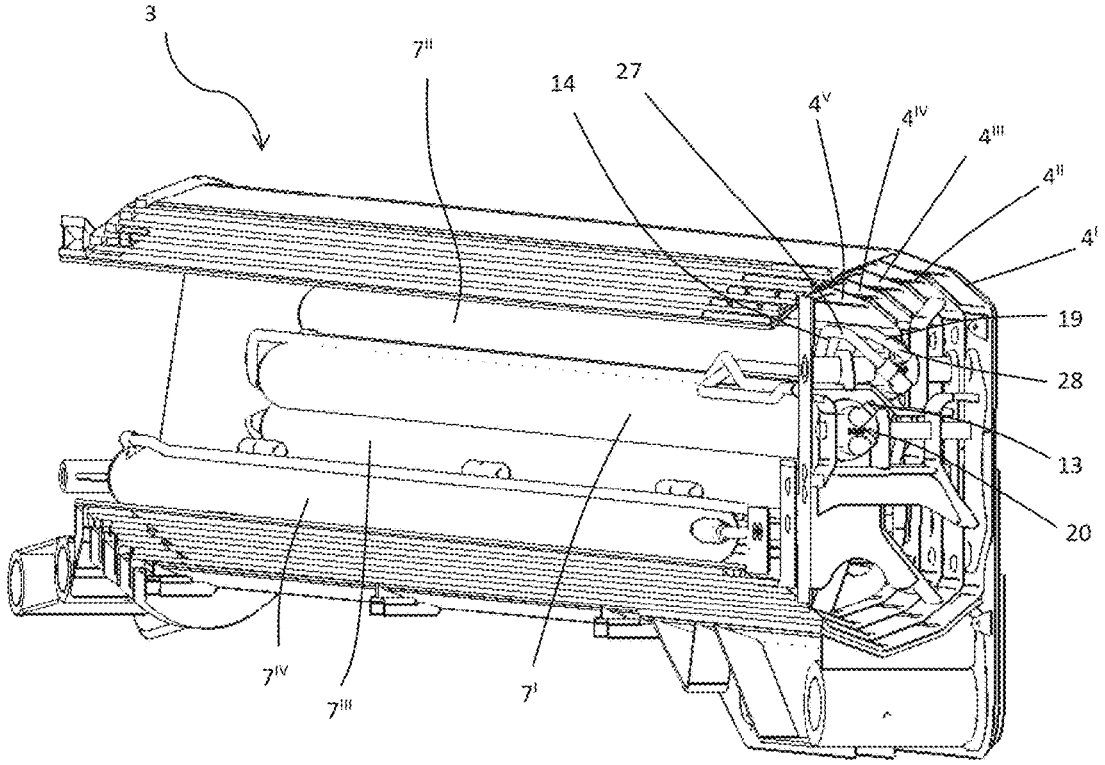
FIG. 3 is a perspective view of the load crane main boom in FIG. 2 longitudinally sectioned.

With reference to FIGS. 2-3, a main boom 3 according to a possible embodiment of the invention is shown. The main boom 3 comprises a fixed first boom section $\mathbf{4}^{I}$, a second boom section $\mathbf{4}^{II}$ which is telescopically arranged inside the fixed first boom section $\mathbf{4}^{I}$ and is movable relative to the latter between a retracted position and an extended position, and at least a third boom section $\mathbf{4}^{III}$ which is telescopically arranged inside the movable second boom section $\mathbf{4}^{II}$ and is movable relative to the latter between a retracted position and an extended position. According to the exemplary embodiment shown, the main boom 3 further comprises a fourth boom section $\mathbf{4}^{IV}$ which is telescopically arranged inside the movable third boom section $\mathbf{4}^{III}$ and is movable relative to the latter between a retracted position and an extended position, and a fifth boom section $\mathbf{4}^{V}$ which is telescopically arranged inside the movable fourth boom section $\mathbf{4}^{IV}$ and is movable relative to the latter between a retracted position and an extended position. When each of the movable boom sections is in the extended position relative to the previous boom section, the main boom 3 reaches its maximum length, whilst when all the movable boom sections are in the retracted position the main boom 3 has its minimum length.

In order to ensure movements of the movable boom sections, the main boom 3 comprises a hydraulic system 6 comprising a plurality of cylinder-piston groups, each connected to a respective boom section and moving, due to a working fluid such as oil under pressure, the boom section subsequent to the boom section to which it is connected. Of course, when a boom section is actuated by a cylinder-piston group connected to the previous boom section, not only this boom section but also all the boom sections subsequent to the latter are moved together.

With reference to the embodiment shown in the Figures, the hydraulic system 6 comprises:

- a first cylinder-piston group $\mathbf{7}^{I}$ integral with the fixed first boom section $\mathbf{4}^{I}$ and connected to the movable second boom section $\mathbf{4}^{II}$ so to move the latter relative to the fixed first boom section $\mathbf{4}^{I}$. When the movable second boom section $\mathbf{4}^{II}$ is actuated by the first cylinder-piston group $\mathbf{7}^{I}$, the movable third $\mathbf{4}^{III}$, fourth $\mathbf{4}^{IV}$ and fifth $\mathbf{4}^{V}$ sections move relative to the fixed first boom section $\mathbf{4}^{I}$ integrally with the movable second boom section $\mathbf{4}^{II}$;
- a second cylinder-piston group $\mathbf{7}^{III}$ integral with the movable second boom section $\mathbf{4}^{II}$ and connected to the movable third boom section $\mathbf{4}^{III}$ so to move the latter relative to the movable second boom section $\mathbf{4}^{II}$. When the movable third boom section $\mathbf{4}^{III}$ is actuated by the second cylinder-piston group $\mathbf{7}^{II}$, the movable fourth $\mathbf{4}^{IV}$ and fifth $\mathbf{4}^{V}$ sections move relative to the movable second boom section $\mathbf{4}^{II}$ integrally with the movable third boom section $\mathbf{4}^{III}$;
- a third cylinder-piston group $\mathbf{7}^{III}$ integral with the movable third boom section $\mathbf{4}^{III}$ and connected to the movable fourth boom section $\mathbf{4}^{IV}$ so to move the latter relative to the movable third boom section $\mathbf{4}^{III}$. When the movable fourth boom section $\mathbf{4}^{IV}$ is actuated by the third cylinder-piston group $\mathbf{7}^{III}$, the movable fifth section $\mathbf{4}^{V}$ moves relative to the movable third boom section $\mathbf{4}^{III}$ integrally with the movable fourth boom section $\mathbf{4}^{IV}$;
- a fourth cylinder-piston group $\mathbf{7}^{IV}$ integral with the movable fourth boom section $\mathbf{4}^{IV}$ and connected to the movable fifth boom section $\mathbf{4}^{V}$ so to move the latter relative to the movable fourth boom section $\mathbf{4}^{III}$.

It is important to be noted that, according to this arrangement, the first $\mathbf{7}^{I}$ and the second $\mathbf{7}^{II}$ cylinder-piston groups are the ones subjected to the maximum loads compared to the others.

Figure 4:
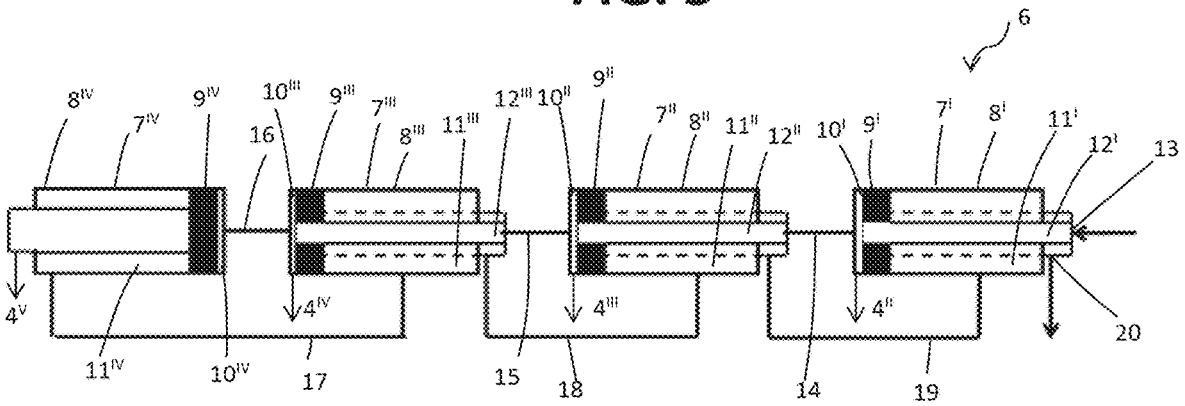
FIG. 4 is a schematic view of a hydraulic system of the load crane main boom according to a possible embodiment of the invention.

With reference to FIG. 4, the hydraulic connections between the cylinder-piston groups are schematically shown. In the schematic FIG. 4, each cylinder-piston group $\mathbf{7}^{I}$, $\mathbf{7}^{II}$, $\mathbf{7}^{III}$ and $\mathbf{7}^{IV}$ respectively comprises a cylinder $\mathbf{8}^{I}$, $\mathbf{8}^{II}$, $\mathbf{8}^{III}$ and $\mathbf{8}^{IV}$ and a piston $\mathbf{9}^{I}$, $\mathbf{9}^{II}$, $\mathbf{9}^{III}$ and $\mathbf{9}^{IV}$. According to the embodiment shown, each cylinder $\mathbf{8}^{I}$, $\mathbf{8}^{II}$, $\mathbf{8}^{III}$ is slidably movable with respect to the respective piston $\mathbf{9}^{I}$, $\mathbf{9}^{II}$, $\mathbf{9}^{III}$ and is connected to a respective main boom section $\mathbf{4}^{II}$, $\mathbf{4}^{III}$ and $\mathbf{4}^{IV}$. Preferably, in the fourth cylinder-piston group $\mathbf{7}^{IV}$ the fourth piston $\mathbf{9}^{IV}$ is slidable relative to the fourth cylinder $\mathbf{8}^{IV}$ and is connected to the fifth main boom section $\mathbf{4}^{V}$. Each piston $\mathbf{9}^{I}$, $\mathbf{9}^{II}$, $\mathbf{9}^{III}$ and $\mathbf{9}^{IV}$ divides the respective cylinder $\mathbf{8}^{I}$, $\mathbf{8}^{II}$, $\mathbf{8}^{III}$ and $\mathbf{8}^{IV}$ in a first camera $\mathbf{10}^{I}$, $\mathbf{10}^{II}$, $\mathbf{10}^{III}$ and $\mathbf{10}^{IV}$ (on the left in FIG. 4 for cylinder-piston groups $\mathbf{7}^{I}$, $\mathbf{7}^{II}$, $\mathbf{7}^{III}$ and on the right for cylinder-piston group $\mathbf{7}^{IV}$) and a second camera $\mathbf{11}^{I}$, $\mathbf{11}^{II}$, $\mathbf{11}^{III}$ and $\mathbf{11}^{IV}$ (on the right in FIG. 4 for cylinder-piston groups $\mathbf{7}^{I}$, $\mathbf{7}^{II}$, $\mathbf{7}^{III}$ and on the left for cylinder-piston group $\mathbf{7}^{IV}$). According to the shown embodiment, the rods of the first $\mathbf{9}^{I}$, second $\mathbf{9}^{II}$ and third $\mathbf{9}^{III}$ pistons comprise a respective through cavity $\mathbf{12}^{I}$, $\mathbf{12}^{II}$, $\mathbf{12}^{III}$.

In FIG. 4, the cylinders $\mathbf{8}^{I}$, $\mathbf{8}^{II}$, $\mathbf{8}^{III}$ and the piston $\mathbf{9}^{IV}$ are depicted in positions such that all the main boom sections connected thereto are in the retracted position. When it is desired to extend the main boom to the maximum length, the hydraulic system 6 is operated as follows. Pressurized oil is injected into the hydraulic system 6 into a first opening 13 at the first cylinder-piston group $7^I$. Then the oil follows the following path: cavity $12^I$, first camera $10^I$, a first tube 14 connecting the first camera $10^I$ and the cavity $12^{II}$, cavity $12^{II}$, first camera $10^{II}$, a second tube 15 connecting the first camera $10^{II}$ and the cavity $12^{III}$, cavity $12^{III}$, first camera $10^{III}$, a third tube 16 connecting the first camera $10^{III}$ and the first camera $10^{IV}$. When the oil reaches the first camera $10^{IV}$, the first cylinder $8^I$ is moved by the oil in the first camera $10^I$, whose volume therefore increases until the first cylinder $8^I$ reaches a stroke end position. As a consequence, the movable second boom section $4^{II}$ moves towards the extended position relative to the fixed first boom section $4^I$. Of course, the second camera $11^I$ volume decreases and the oil contained therein is discharged through a second opening 20 at the first cylinder-piston group $7^I$, preferably near the first opening 13.

If oil under pressure is still injected into the hydraulic system 6 through the first opening 13 after the first cylinder $8^I$ has reached the end stroke position, the same movements happen in sequence in the second $7^{II}$ and in the third $7^{III}$ cylinder-piston groups. In particular, the second cylinder $8^{II}$ is moved by the oil in the first camera $10^{II}$, whose volume therefore increases until the second cylinder $8^{II}$ reaches a stroke end position. As a consequence, the movable third boom section $4^{III}$ moves towards the extended position relative to the movable second boom section $4^{II}$. Then, the third cylinder $8^{III}$ is moved by the oil in the first camera $10^{III}$, whose volume therefore increases until the third cylinder $8^{III}$ reaches a stroke end position. As a consequence, the movable fourth boom section $4^{IV}$ moves towards the extended position relative to the movable third boom section $4^{III}$. Finally, if oil under pressure is still injected into the hydraulic system 6 through the first opening 13 after the third cylinder $8^{III}$ has reached the end stroke position, in the fourth cylinder-piston group $7^{IV}$ oil under pressure in the first camera $10^{IV}$ moves the fourth piston $9^{IV}$ towards the extended position. This corresponds to a fully extended configuration of the main boom 3. When fourth piston $9^{IV}$ moves, the second camera $11^{IV}$ volume decreases and oil to be discharged follows the following path: second camera $11^{IV}$, a fourth tube 17 connecting the second camera $11^{IV}$ and the second camera $11^{III}$, second camera $11^{III}$, a fifth tube 18 connecting the second camera $11^{III}$ and the second camera $11^{II}$, second camera $11^{II}$, a sixth tube 19 connecting the second camera $11^{II}$ and the second camera $11^I$, second camera $11^I$ and then a second opening 20 at the first cylinder-piston group $7^I$, preferably near the first opening 13, where the oil in excess is discharged.

As it is clear from the above description, the boom sections reaches the extended position in sequence, starting from the second boom section $4^{II}$ to the fifth boom section $4^V$. As will be clear to the skilled person, this result can be achieved by properly selecting different areas of each piston/cylinder, which however, for the sake of simplicity, are depicted with the same areas in FIG. 4.

When, starting from the fully extended position of the main boom, it is desired to retract it again, oil can be injected into the hydraulic system through the second opening 20 such that opposite movement are obtained. The excess oil in this case is discharged through the first opening 13.

Of course, any intermediate position of the main boom 3 between the fully extended position and the fully retracted position can be obtained by stopping the oil injection in the proper moment and closing both the first 13 and the second 20 opening.

Figure 5:
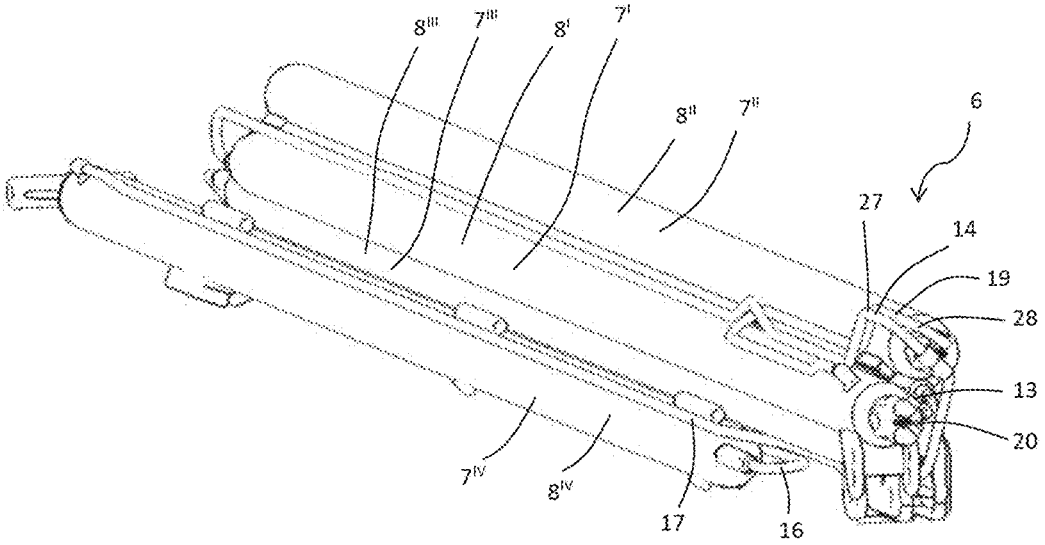
FIGS. 5 and 6 are perspective views of the hydraulic system of the load crane main boom according to a possible embodiment of the invention.
Figure 6:
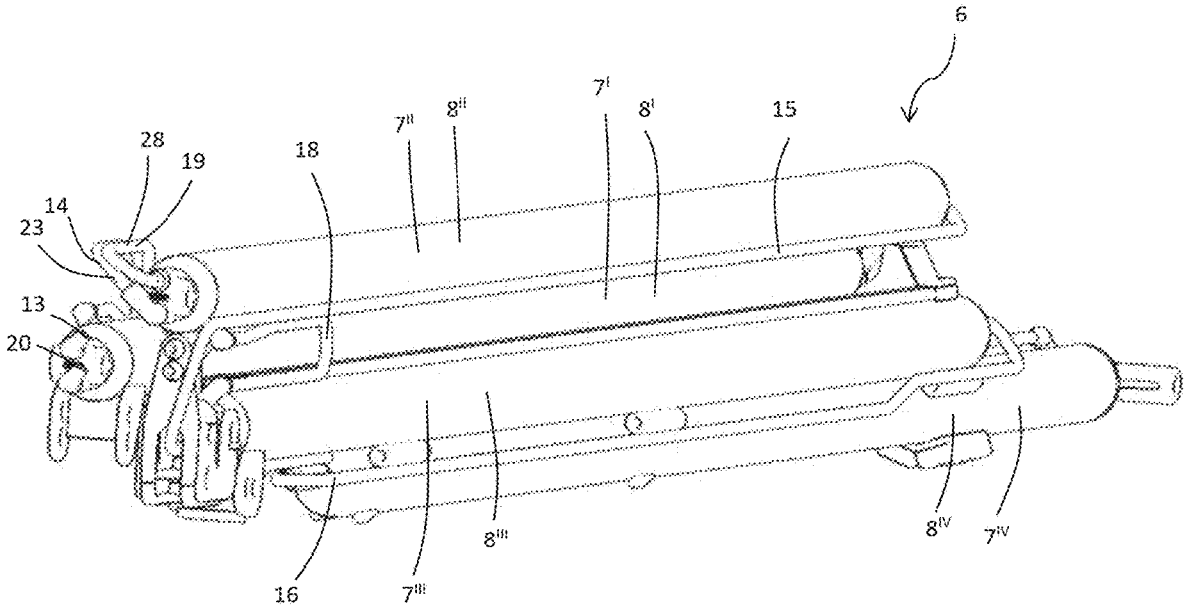

FIGS. 5-6 show a possible constructive embodiment of the scheme in FIG. 4. In particular, FIGS. 5-6 show the cylinder-piston groups $7^I$, $7^{II}$, $7^{III}$ and $7^{IV}$ with the respective cylinders $8^I$, $8^{II}$, $8^{III}$ and $8^{IV}$, as well as the first opening 13, the second opening 20, the first 14, second 15, third 16, fourth 17, fifth 18 and sixth 19 tubes. It is to be noted that cylinder-piston groups $7^I$, $7^{II}$, $7^{III}$ and $7^{IV}$ form preferably an assembly which can be inserted as a whole into the main boom 3 preferably through the last boom section, which is smallest one in section. With reference to the embodiment in Figures, the cylinder-piston groups assembly can be inserted as a whole into the main boom 3 preferably through the opening of the movable fifth section $4^V$.

Figure 7:
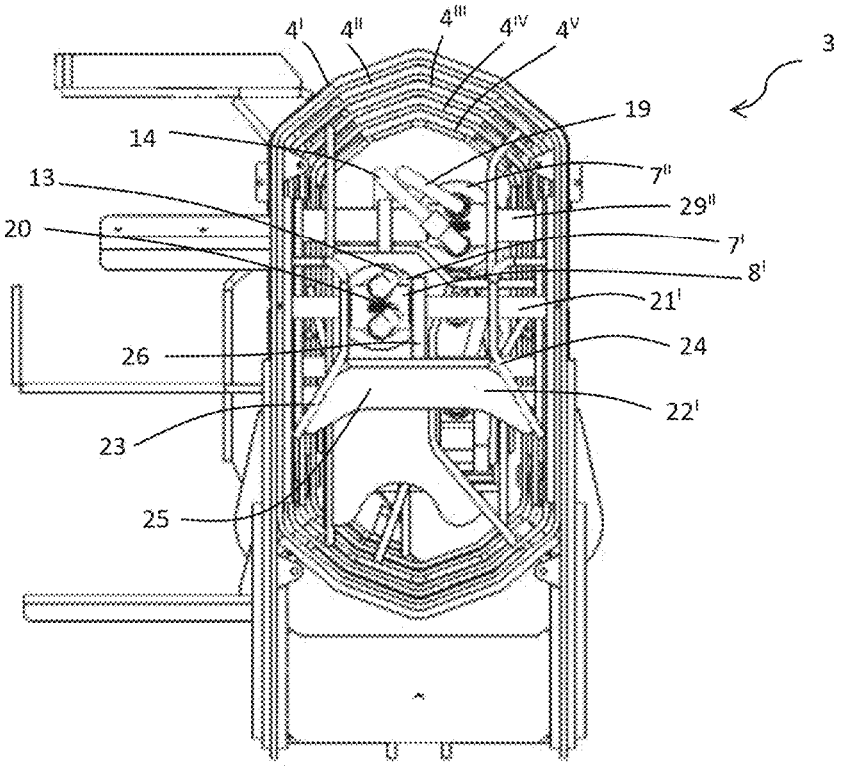
FIG. 7 is a side view of the load crane main boom in FIG. 2.

FIG. 7 shows a view of the main boom 3 on the side where the boom is connected to the column 2. The boom sections $4^I$, $4^{II}$, $4^{III}$, $4^{IV}$ and $4^V$ are tubular and telescopically arranged one inside each other. In particular, preferably, the fixed first boom section $4^I$ is the outermost one, whilst the movable fifth boom section $4^V$ is the innermost one. Preferably, each boom section has ten sides: four upper sides, four lower sides and two opposite lateral sides, preferably vertically oriented.

Given the boom sections arrangement described above, the first cylinder-piston group $7^I$ is the one subjected to the maximum loads, in particular axial loads (wherein "axial" is to be intended as the main boom development direction, corresponding to the movement direction of each main boom section). Therefore the first cylinder-piston group $7^I$ comprises a transversal first main rod $21^I$ connected to the lateral sides of the fixed first boom section $4^I$ supporting the first cylinder $8^I$. The first main rod $21^I$ is preferably orthogonally oriented with respect to the main boom axial direction. Advantageously, in order to minimize the first main rod $21^I$ bending in the main boom axial direction, the main boom 3 comprises a first reinforcing plate $22^I$ connected to the first boom section $4^I$ and comprising reinforcing elements which support the first main rod $21^I$. According to a possible embodiment, the first reinforcing plate $22^I$ comprises two opposite C-shaped lateral portions 23 and 24, whose respective endings are internally fixed, preferably welded, to the first boom section $4^I$, and a plate-like central portion 25 connecting the two lateral portions 23 and 24. The two opposite C-shaped lateral portions 23 and 24 comprise through holes (not visible in the figures) where the first main rod $21^I$ can be arranged, so to form reinforcing elements for the latter. Preferably, the plate-like central portion 25 further comprises a third reinforcing element 26 (also having a through hole where the first main rod $21^I$ can be arranged) in an intermediate position between the reinforcing elements formed by the C-shaped lateral portions 23 and 24. The first cylinder $7^I$ can be positioned between the C-shaped lateral portion 23 and the third reinforcing element 26 (as shown in FIG. 7), or, alternatively, between the third reinforcing element 26 and the C-shaped lateral portion 24.

It is to be noted that, since the main boom 3 is laterally open, the tubes to be connected to the first opening 13 and the second opening 20 of the first cylinder $8^I$ come from the outside, so they do not affect in a substantial manner the overall dimensions of the main boom. This is not the case for the tubes, in particular for the first 14 and sixth 19 tubes connected to the second cylinder $8^{II}$, which, on the contrary, in principle can heavily affect the main boom dimensions and therefore must be properly positioned, as will be discussed in detail hereunder.

Figure 8:
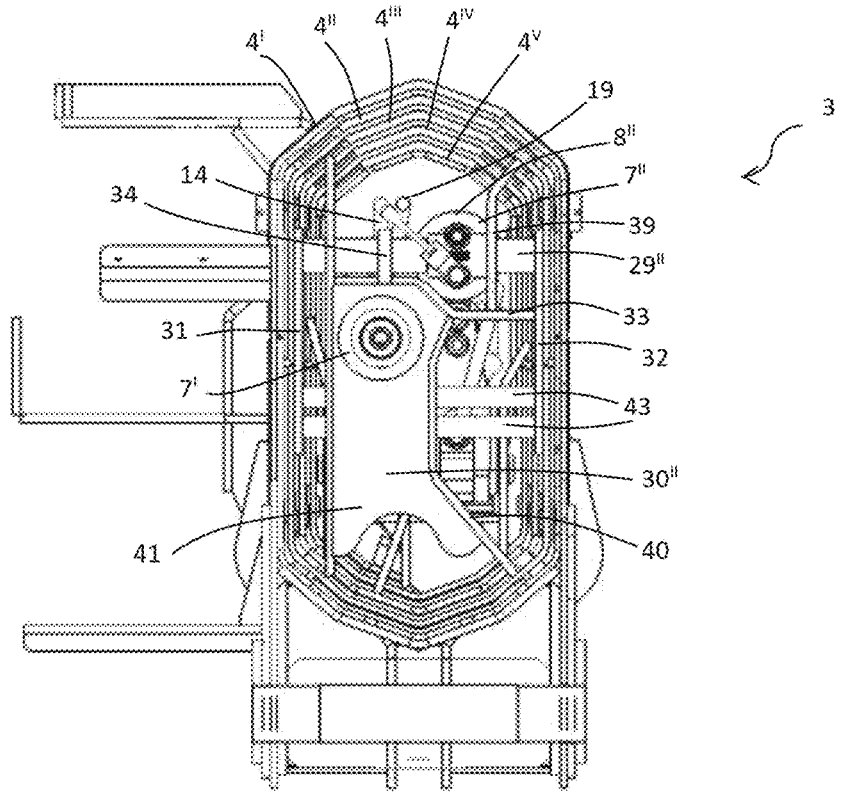
FIG. 8 is a view of the load crane main boom in FIG. 2 in a transversal section.
Figure 9:
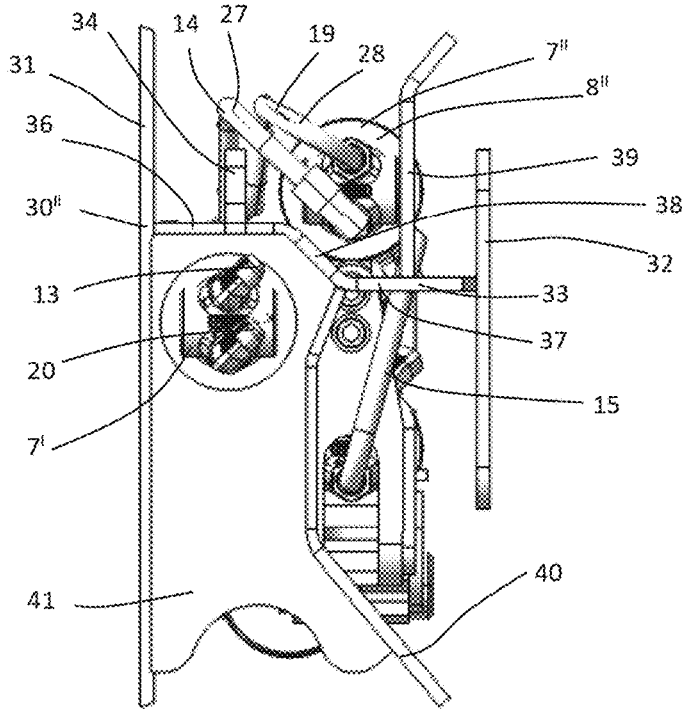
FIG. 9 is a side view of a portion of FIG. 8.
Figure 10:
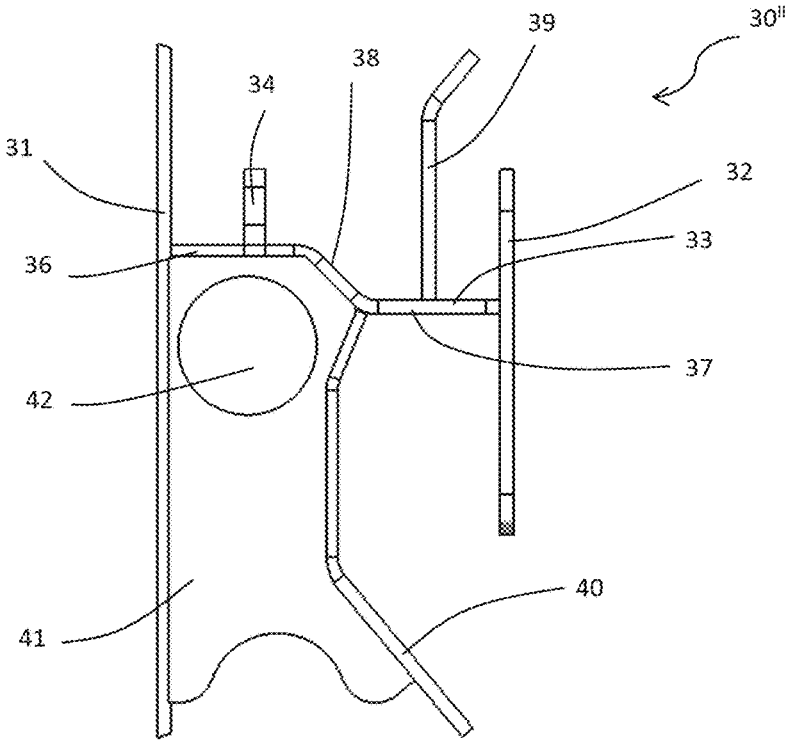
FIG. 10 is a side view of a portion of FIG. 9.

With reference now to FIGS. 8-10 the arrangement of the second cylinder-piston group $7^{II}$ will be described. FIG. 7 shows in particular a transversal section of the main boom 3, in correspondence of a plane where the second cylinder-piston group $7^{II}$ is positioned, seen from the side of the main boom where the latter is connected to the column 3. The first tube 14 and the sixth tube 19 hydraulically connecting the second cylinder-piston group $7^{II}$ to the first cylinder-piston group $7^{I}$, as described above, at least partially extend along the second cylinder $8^{II}$ axial direction and are connected to the latter at the head thereof, where they form respective bends 27 and 28.

The main boom 3 comprises a transversal second main rod $29^{II}$ internally connected to the lateral sides of the movable second boom section $4^{II}$ supporting the second cylinder $8^{II}$. The second main rod $29^{II}$ is preferably orthogonally oriented with respect to the main boom axial direction.

In order to minimize the second main rod $29^{II}$ bending in the main boom axial direction, the main boom 3 comprises a second reinforcing plate $30^{II}$ connected to the second boom section $4^{II}$ and comprising reinforcing elements which support the second main rod $29^{II}$.

The second reinforcing plate $30^{II}$ comprises two opposite, preferably plate-shaped, lateral portions 31 and 32 internally fixed, preferably welded, to the second boom section $4^{II}$. For example, the lateral portions 31 and 32 can be fixed to the lateral sides of the ten-sided section of the main boom second section $4^{II}$. The lateral portions 31 and 32 comprises through holes (not visible in the figures) where the second main rod $29^{II}$ can be arranged, so to form first and second reinforcing elements for the latter.

The second reinforcing plate $30^{II}$ further comprises a central portion 33 connecting the two lateral portions 31, 32. The central portion 33 comprises a third reinforcing element 34 (also having a through hole, not shown in the figures, where the second main rod $29^{II}$ can be arranged) in an intermediate position between the lateral portion 31 and the second cylinder $8^{II}$. In addition, the central portion 33 comprises a raised section 36, a lowered section 37 and a connecting section 38 which connects the raised section 36 and the lowered section 37. Is it to be noted that the words "raised" and "lowered" are referred to the height of the main boom section with respect to the axial direction as shown for example in FIG. 8. On one side of the central portion 33, in particular on the upper side (with reference to the normal conditions of use of the main boom 3), the third reinforcing element 34 is positioned in correspondence of the raised section 36 and the second cylinder $8^{II}$ is positioned in correspondence of the lowered section 37. The bends 27 and 28 of the first 14 and the sixth 19 tubes are inclined, starting from the head of the second cylinder $8^{II}$, towards the third reinforcing element 34, i.e. they are not in vertical position. In particular, the bends 27 and 28 of the first 14 and the sixth 19 tubes can extend in the free space above the reinforcing element 34.

On the other side of the central portion 33, in particular on the lower side (with reference to the normal conditions of use of the main boom 3), the first cylinder $8^{I}$ is positioned in correspondence of the raised section 36.

Thanks to the lowered position of the second cylinder $8^{II}$ and to the inclined orientation of the bends 27 and 28 of the first 14 and the sixth 19 tubes on the upper side of the second reinforcing plate $30^{II}$, and thanks to the raised position of the first cylinder $8^{I}$ on the lower side of the second reinforcing plate $30^{II}$, the height of the main boom 3 can be minimized, while maintaining an adequate stiffness of the second main rod $29^{II}$ and an adequate diameter and bending radius of the bends 27 and 28 of the first 14 and the sixth 19 tubes.

According to a possible embodiment, the second reinforcing plate $30^{II}$ further comprises a fourth reinforcing element 39 (also having a through hole, not shown, where the second main rod $29^{II}$ can be arranged) in an intermediate position between the second cylinder $8^{II}$ and the lateral portion 32. The fourth reinforcing element 39 is positioned in correspondence of the lowered section 37 and is internally connected, preferably welded, at its free end to the second boom section $4^{II}$. To this purpose, depending on the shape of the second boom section $4^{II}$, the fourth reinforcing element 39 free end can be bended, as shown for example in the exemplary embodiment in the figures.

According to a possible embodiment, the second reinforcing plate $30^{II}$ further comprises an auxiliary connecting portion 40 on the side opposite to the side where the third reinforcing element 34 is positioned. The auxiliary connecting portion 40 is internally connected, preferably welded, at its free end to the second boom section $4^{II}$. Again, the auxiliary connecting portion 40 can be bended in order to match the second boom section $4^{II}$ shape for welding.

According to a possible embodiment, the second reinforcing plate $30^{II}$ further comprises a, preferably plate-like, stiffening element 41 acting between the first lateral portion 31 and the auxiliary connecting portion 40. Advantageously, the stiffening element 41 comprise a through hole 42 such that the first cylinder $8^{I}$ can axially pass therethrough.

It is to be noted that, as described above, the first cylinder $8^{I}$ movements cause movements of the second boom section $4^{II}$ with respect to the first boom section $4^{I}$. It is therefore necessary to connect the first cylinder $8^{I}$ to the second boom section $4^{II}$. To this purpose, according to a possible embodiment, the first cylinder-piston group $7^{I}$ comprises one or more connecting rods 43 connected to the lateral sides of the second boom section $4^{II}$. The connecting rods 43 are preferably orthogonally oriented with respect to the main boom axial direction.

Advantageously, in order to allow the passage of the connecting rods 43, the second reinforcing plate $30^{II}$ lateral portions 31 and 32 comprise corresponding through holes (not shown).

The third $4^{III}$ and the subsequent cylinder-piston groups can be connected to the respective boom sections in a standard manner because they are subjected to lower loads and therefore there is no necessity to provide as many reinforcing elements. Consequently, their dimensions do not represent a substantial constraint for the main boom dimensions.

Figure 11:
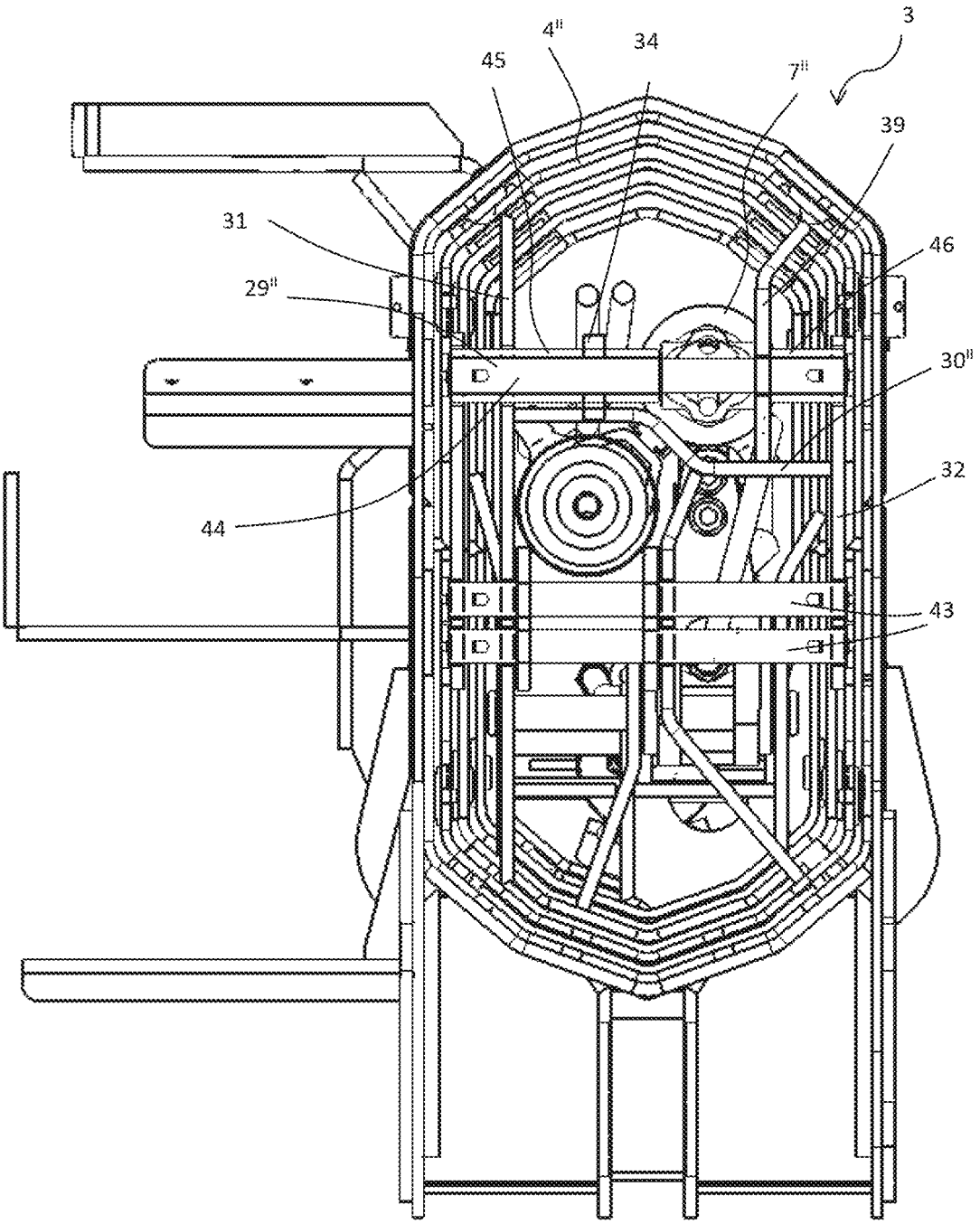
FIG. 11 is a view of the load crane main boom in FIG. 2 in a further transversal section.

Advantageously, the third reinforcing element 34 is laterally positioned at a distance from the second cylinder-piston group $7^{II}$ such that more space is obtained for housing the bends 27, 28 of the first 14 and sixth 19 tubes. As a consequence, the third reinforcing element 34 cannot act as a lateral abutment for the second cylinder-piston group $7^{II}$. In order to overcome the lacking of such abutment, advantageously, the second main rod $29^{II}$ comprises a core 44 and a first 45 and a second 46 sleeves positioned on the core 44 (see FIG. 11). The first sleeve 45, in particular, acts as a lateral abutment for the second cylinder-piston group $7^{II}$ on one side, whilst on the other side the second abutment can be for example formed by the fourth reinforcing element 39. The second sleeve 46, in turn, can be positioned on the opposite side with respect to the fourth reinforcing element 34, so to act as a reinforcing element acting between the fourth reinforcing element 39 and the lateral portion 32.

To the above-mentioned embodiments of the load crane main boom according to the invention, the skilled person, in order to meet specific current needs, can make several additions, modifications, or substitutions of elements with other operatively equivalent elements, without however departing from the scope of the appended claims.

The invention claimed is:

1. A load crane main boom comprising:

a tubular fixed first boom section, a tubular second boom section telescopically arranged and movable relative to the fixed first boom section between a retracted position and an extended position to define a moveable second boom section, and at least a tubular third boom section telescopically arranged and movable relative to the movable second boom section between a retracted position and an extended position to define a third moveable boom section;

a hydraulic system comprising:

a first cylinder-piston group axially extending within the main boom, integrally connected with the fixed first boom section and connected to the movable second boom section so as to move the moveable second boom section relative to the fixed first boom section under the action of a pressurized working fluid;

a second cylinder-piston group axially extending within the main boom, integrally connected with the movable second boom section and connected to the movable third boom section so to move the movable third boom section relative to the movable second boom section under the action of said pressurized working fluid;

a first opening and a second opening at the first cylinder-piston group for at least one of injecting pressurized working fluid into the hydraulic system or discharging pressurized working fluid from the hydraulic system;

a first tube and a sixth tube hydraulically connecting the first and the second cylinder-piston groups, the first tube and the sixth tube at least partially extending near the second cylinder-piston group along the axial direction and connected to the second cylinder-piston group in such a manner so that the first tube and the sixth tube form respective bends, wherein the main boom further comprises:

a transversal second main rod connected to the second boom section supporting the second cylinder-piston group, and a second reinforcing plate connected to the second boom section, comprising:

a first and second opposite lateral portions internally fixed to the second boom section and comprising through holes where the second main rod is arranged, to form first and second reinforcing elements for the second boom section;

a central portion connecting said first and second lateral portions and the central portion comprising a raised section, a lowered section and a section connecting the raised section and the lowered section;

a third reinforcing element having a through hole where the second main rod is arranged, said third reinforcing element being arranged in an intermediate position between the first lateral portion and the second cylinder-piston group, wherein on a first side of the central portion, the third reinforcing element is positioned in correspondence of the raised section and the second cylinder-piston group is positioned in correspondence of the lowered section, said bends of the first and sixth tubes being inclined towards the third reinforcing element, and wherein on a second side of the central portion, the first cylinder-piston group is positioned in correspondence of the raised section.

2. A load crane main boom according to claim 1, wherein said first side of the central portion corresponds to an upper side and said second side of the central portion corresponds to a lower side.

3. A load crane main boom according to claim 1, wherein the second main rod is orthogonally oriented with respect to the main boom axial direction.

4. A load crane main boom according to claim 1, wherein the second reinforcing plate—further comprises a fourth reinforcing element having a through hole where the second main rod is arranged, said fourth reinforcing element being in an intermediate position between the second cylinder-piston group and the second reinforcing plate second lateral portion.

5. A load crane main boom according to claim 4, wherein the fourth reinforcing element is positioned in correspondence of the lowered section on said first side and is internally connected at a free end to the second boom section.

6. A load crane main boom according to claim 1, wherein the second reinforcing plate—further comprises an auxiliary connecting portion on said second side, said auxiliary connecting portion being internally connected at a free end to the second boom section.

7. A load crane main boom according to claim 6, wherein the second reinforcing plate—further comprises a stiffening element acting between the first lateral portion and the auxiliary connecting portion positioned on said second side.

8. A load crane main boom according to claim 7, wherein said stiffening element is plate-shaped and comprises a through hole such that the first cylinder-piston group axially passes therethrough.

9. A load crane main boom according to claim 1, further comprising one or more connecting rods supporting the first cylinder-piston group, said one or more connecting rods being orthogonally oriented with respect to the main boom axial direction and connected to the second boom section so to move the second boom section, wherein the first and second lateral portions comprise corresponding one or more through holes such that the one or more connecting rods axially pass therethrough.

10. A load crane main boom according to claim 1, wherein the third reinforcing element is laterally positioned at a distance from the second cylinder-piston group and the second main rod comprises a core and a first and a second sleeves positioned on the core, wherein the first sleeve is positioned between the first lateral portion and the fourth reinforcing element and acts as a lateral abutment for the second cylinder-piston group.

11. A load crane main boom according to claim 10, wherein the second sleeve is positioned between the fourth reinforcing element and the second lateral portion.

12. A load crane comprising a main boom according to claim 1.

* * * * *